United States Patent [19]

Kopec et al.

[11] 4,449,493

[45] May 22, 1984

[54] SLOSH BAFFLE FOR OIL PAN OF INTERNAL COMBUSTION ENGINE

[75] Inventors: Eduard Kopec, Remseck; Wolfgang Oberknapp, Marbach, both of Fed. Rep. of Germany

[73] Assignee: Filterwerk Mann & Hummel GmbH, Ludwigsburg, Fed. Rep. of Germany

[21] Appl. No.: 410,698

[22] Filed: Aug. 23, 1982

[30] Foreign Application Priority Data

Aug. 21, 1981 [DE] Fed. Rep. of Germany ... 8124422[U]

[51] Int. Cl.[3] ..... F01M 1/00

[52] U.S. Cl. ..... 123/196 A; 123/196 R; 123/198 E

[58] Field of Search ..... 123/196 A, 196 R, 198 E

[56] References Cited

U.S. PATENT DOCUMENTS 4,239,029 12/1980 Streicher et al. ..... 123/196 R

FOREIGN PATENT DOCUMENTS 1113610 9/1961 Fed. Rep. of Germany ... 123/196 A
1183750 12/1964 Fed. Rep. of Germany ... 123/196 A
1526522 7/1972 Fed. Rep. of Germany .

*Primary Examiner*—Wendell E. Burns
*Assistant Examiner*—E. Rollins Cross
*Attorney, Agent, or Firm*—Joseph A. Geiger

[57] ABSTRACT

A slosh baffle for selective and retroactive installation in the oil pan of an in-line internal combustion engine for automotive vehicles, the slosh baffle being attachable to the rim of the oil suction strainer by snap-action assembly, its transverse orientation being determined by means of a saddle portion on the slosh baffle which engages an elbow of the oil suction line. Attachment to the strainer rim is obtained by means of several downwardly depending flexible snap hooks on the periphery of a supporting flange of the slosh baffle, in cooperation with separate centering lugs.

9 Claims, 4 Drawing Figures

SLOSH BAFFLE FOR OIL PAN OF INTERNAL COMBUSTION ENGINE

BACKGROUND OF THE INVENTION

1. Field of the Invention

The present invention relates to internal combustion engines and, more particularly, to a slosh baffle for the oil pan of an internal combustion engine, especially of the in-line type which is used in automotive vehicles.

2. Description of the Prior Art

The purpose of a slosh baffle in the oil pan of an internal combustion engine is to prevent the oil from flowing towards one or the other longitudinal extremity of the oil pan during acceleration or deceleration of the vehicle, as a result of which the oil level around the oil suction strainer may drop to such an extent that the strainer may emerge from the oil level and air may be sucked into the lubrication circuit. Such an occurrence is highly undesirable, creating the risk of damage to the bearing surfaces which are to be lubricated.

The use of a slosh baffle has been suggested previously in the German Pat. No. 15 26 552 which discloses the arrangement of a vertically oriented wall near the oil suction strainer, the wall being an integral part of the oil pan casting. Lateral flow gaps between the slosh baffle and the side walls of the oil pan permit a throttled longitudinal equalizing flow.

Obviously, such an integrally cast slosh baffle precludes its selective installation in some engines and not in others. Such selectivity may be necessary, however, in connection with certain in-line internal combustion engines which are to be mounted in the vehicle in different orientations, so that, in one orientation, a slosh baffle may be necessary and, in another orientation, a slosh baffle may not be needed, or may even be undesirable.

Also known from the prior art is a slosh baffle of sheet metal which is permanently attached to the oil suction strainer by means of a weld.

SUMMARY OF THE INVENTION

Underlying the present invention is the objective of devising an improved slosh baffle for the oil pan of an inline internal combustion engine which is free of the above-mentioned shortcomings of the prior art devices.

In order to attain this objective, the present invention suggests a slosh baffle assembly for the stabilization of the oil level against longitudinal flowoff to either oil pan extremity which features a retroactively installable slosh baffle in the form of a vertical panel extending transversely to the oil pan, so as to form narrow flow gaps with the walls of the oil pan, thereby subdividing the latter into two oil chambers which are linked by the flow gaps.

In a preferred embodiment of the invention, the slosh baffle has a horizontally extending saddle portion engaging the elbow of the oil suction line from above, to secure the transverse orientation of the slosh baffle in the oil pan. The attachment of the slosh baffle assembly to the oil suction strainer is preferably accomplished by means of a plurality of snap hooks which are arranged on the periphery of a supporting flange of the slosh baffle assembly, the hooks engaging an annular rim on the upper end of the strainer. Separate downwardly depending lugs on the supporting flange provide a centering engagement with the strainer rim.

The snap hooks are preferably in the shape of an inverted "U" with legs of unequal length, the extremity of the shorter leg being on the inside and attached to the supporting flange, while the extremity of the longer, outer leg carries a retaining nose which is engageable under the rim of the oil suction strainer. The slosh baffle, its saddle portion, supporting flange and its snap hooks are preferably integral portions of an injection-molded part.

The proposed slosh baffle has the advantage of being ideally suited for mass production at low cost and problem-free installation by unskilled labor. The arrangement of a saddle portion on the slosh baffle in engagement with the suction line elbow assures the transverse positioning of the slosh baffle assembly, making it possible for the oil suction strainer to be of circular outline.

The U-shape of the snap hooks provides sufficient radial displacement flexibility on the retaining noses of the snap hooks for their engagement past the strainer rim.

In order to eliminate the need for transversely movable core elements in the injection molding die for the proposed slosh baffle, the invention further suggests a vertical opening in the U-shaped snap hooks of a cross section which is at least as large as the area of horizontal extent of the retaining nose. This is conveniently accomplished by a retaining nose which is narrower than the remainder of the snap hook and by a slightly larger transverse slot in the base portion and in part of the adjoining legs of the U-shaped snap hooks.

BRIEF DESCRIPTION OF THE DRAWINGS

Further special features and advantages of the invention will become apparent from the description following below, when taken together with the accompanying drawings which illustrate, by way of example, a preferred embodiment of the invention which is represented in the various figures as follows.

DESCRIPTION OF THE PREFERRED EMBODIMENT

Figure 1:
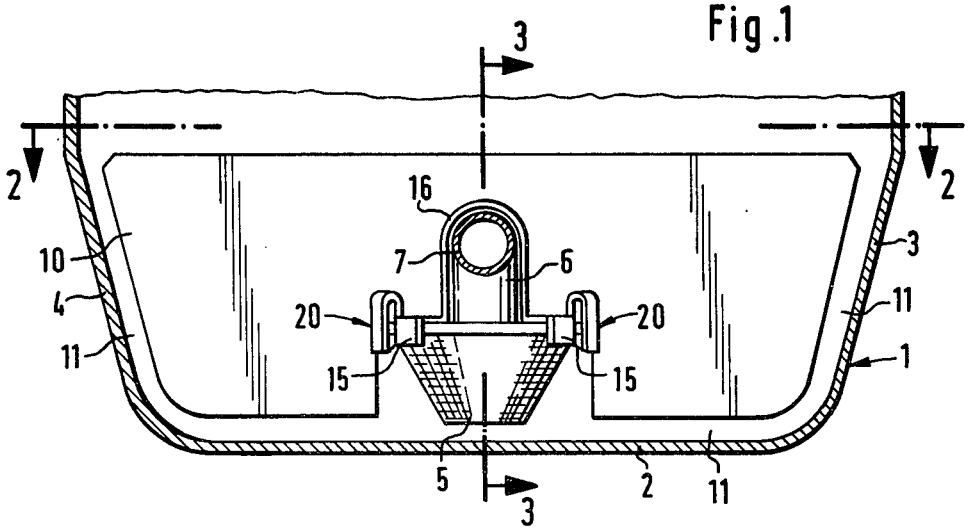
FIG. 1 shows, in a vertical transverse cross section, an oil pan of an internal combustion engine with a slosh baffle assembly embodying the present invention, the cross section being taken along line 1—1 of FIG. 2.
Figure 2:
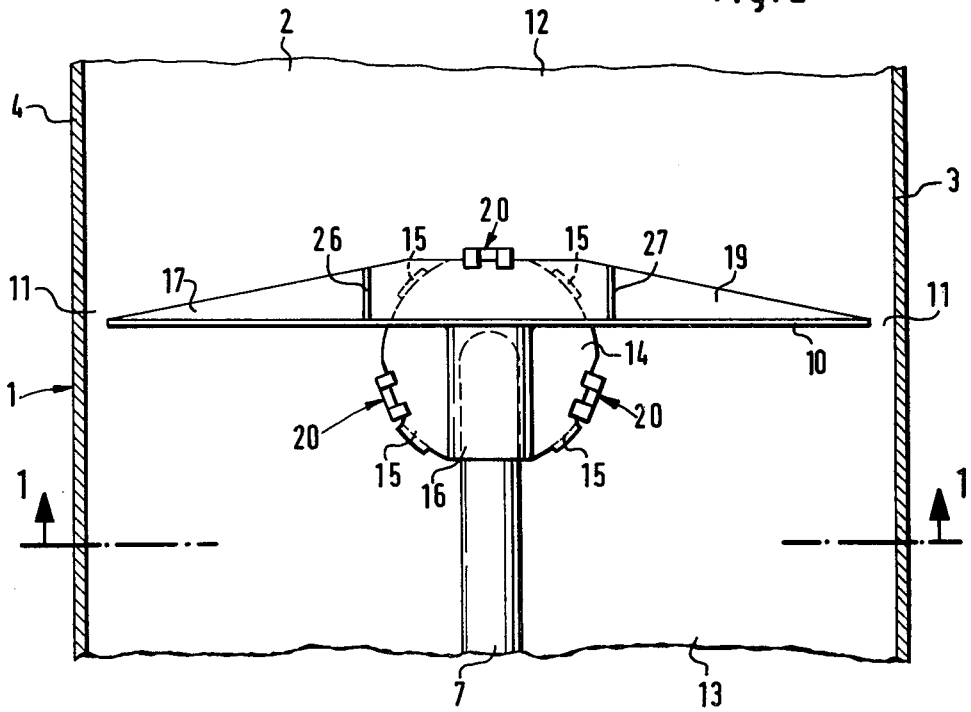
FIG. 2 shows the slosh baffle assembly of FIG. 1 in a plan view, with the oil pan cross-sectioned along line 2—2 of FIG. 1.

Referring to the drawings, FIG. 1 shows an oil pan 1 of an in-line internal combustion engine for automotive vehicles which has a bottom wall 2 and inclined side walls 3 and 4. Centrally and at a small distance from the bottom wall 2 of the oil pan 1 is arranged an oil suction strainer 5. The latter has an oil intake opening on its lower side and a cleaning mesh which strains the oil as it enters the oil suction strainer. On the upper side of the strainer 5 is arranged an elbow 6 to which is connected a horizontal oil suction line 7 leading to an oil pump which is not shown. On its upper extremity, the oil suction strainer has a peripheral annular rim 9.

By means of its rim 9, the oil suction strainer 5 carries a slosh baffle 10 in the form of a vertically oriented panel which extends transversely to the longitudinal axis of the in-line internal combustion engine. The bottom edge and the two side edges of the slosh baffle 10 are arranged at a small distance from the bottom wall 2 and the side walls 3 and 4 of the oil pan 1, thereby forming narrow flow gaps 11 between the slosh baffle 10 and the oil pan walls, while the space of the oil pan 1 is longitudinally subdivided into two oil chambers 12 and 13.

The slosh baffle 10 is preferably an injection-molded part, having integrally attached thereto a supporting flange 14 with which it rests on the annular rim 9 of the oil suction strainer 5. The supporting flange 14 carries four downwardly depending regularly spaced centering lugs 15 which engage the periphery of the strainer rim 9 to provide a centering action between the slosh baffle 10 and the oil suction strainer 5.

The transverse orientation of the slosh baffle 10 is determined by a saddle portion 16 of the slosh baffle which extends horizontally from the mid-portion of the latter, so as to reach over and engage the elbow 6. The slosh baffle thus straddles the oil suction strainer 5, being centered on is rim 9 and angularly positioned by the elbow 6 of the oil suction line 7.

Figure 3:
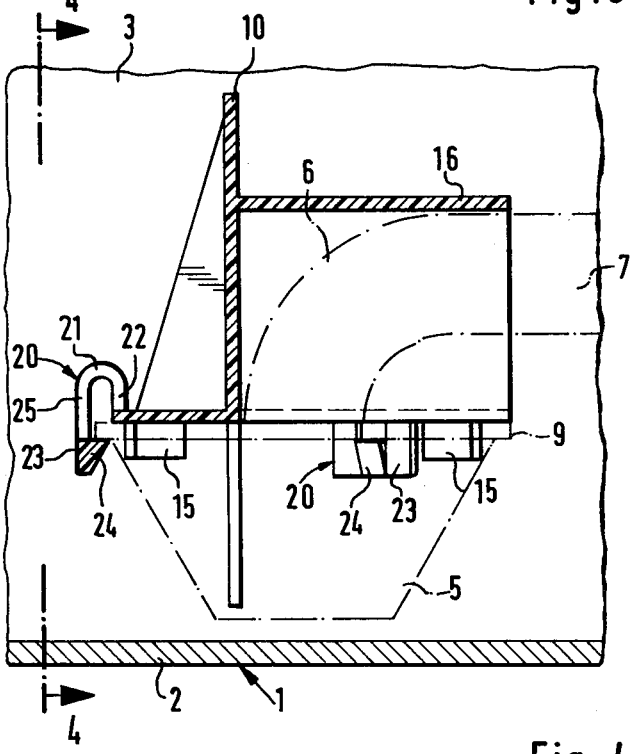
FIG. 3 shows, at an enlarged scale, a longitudinal cross section through the slosh baffle assembly, taken along line 3—3 of FIG. 1.

On the periphery of the supporting flange 14 are further arranged three snap hooks 20. As can best be seen in FIGS. 1 and 3, each snap hook has the shape of an inverted "U" with vertical legs of unequal length. The shorter, inner leg 22 has its extremity integrally attached to the edge of the supporting flange 14, while the longer, outer leg 23 carries on its extremity a retaining nose 24. This retaining nose 24 extends radially inwardly into engagement with the underside of the rim 9 of the oil suction strainer 5. The U-shaped outline gives the snap hook 20 the necessary radial flexibility, so that the retaining noses 24 slide over the rim 9, when the slosh baffle is pushed downwardly against the oil suction strainer 5. Accordingly, the attachment of the slosh baffle to the strainer rim involves nothing more than a simple downward movement of the slosh baffle against the oil suction strainer.

Figure 4:
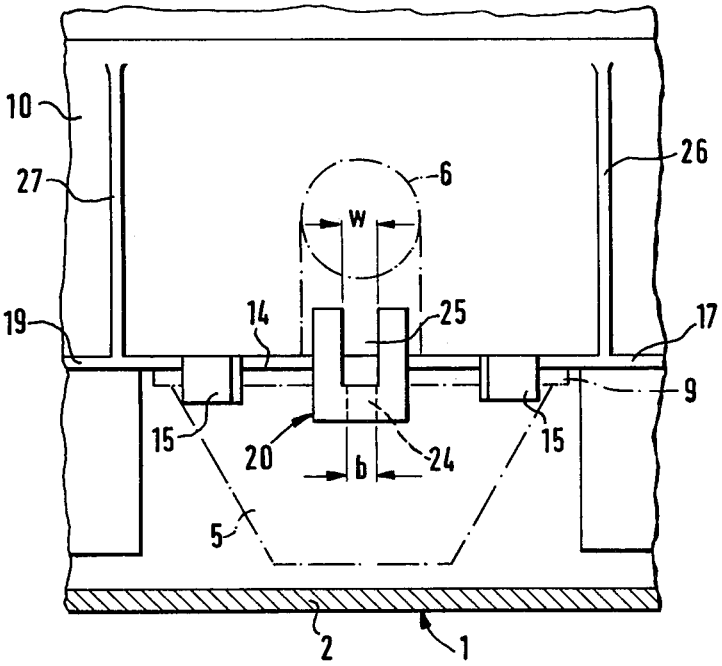
FIG. 4 shows portions of the slosh baffle assembly in a transverse cross section taken along line 4—4 of FIG. 3.

In order to avoid the need for complex transversely retractable core members in the injection molding die for the proposed slosh baffle, the snap hooks 20 are provided with vertical openings above their retaining noses 24. Such an opening is preferably in the form of a slot 25 (FIG. 4) which extends through the inner and outer legs 22 and 23 and the base portion 21 of the U-shape, reaching from the supporting flange 14 to the retaining nose 24. The width w of the slot 25 must be equal to, or greater than the width b of the retaining nose 24.

Two horizontal ribs 17 and 19 in alignment with the supporting flange 14, and two vertical bracing ribs 26 and 27 on opposite sides of the supporting flange 14 serve to reinforce and stiffen the slosh baffle 10.

As stated earlier, the attachment of the slosh baffle 10 to the oil suction strainer 5 involves a simple snap-action procedure. This means that the slosh baffle can be installed retroactively and selectively, depending on the specific operational requirements of the internal combustion engine. In the installed position, the snap hooks 20 provide a secure clamping action between the supporting flange 14 of the slosh baffle 10 and the rim 9 of the oil suction strainer 5. The position of the slosh baffle 10 on the strainer 5 is determined by its centering lugs 15, and its transverse orientation in the oil pan 1 is maintained by its saddle portion 16 which engages the elbow 6 of the oil suction line 7.

Under acceleration or deceleration forces in the longitudinal sense of the internal combustion engine, the oil in the oil pan 1 tends to flow in the opposite direction, towards one of the longitudinal extremities of the oil pan 1. The slosh baffle 10 restrains this flowoff by reducing the flow cross section to the narrow flow gaps 11 between the edges of the slosh baffle 10 and the walls of the oil pan 1. It follows that the longitudinal flowoff and the consequent emergence of the oil suction strainer 5 from the oil level are effectively prevented.

It should be understood, of course, that the foregoing disclosure describes only a preferred embodiment of the invention and that it is intended to cover all changes and modifications of this example of the invention which fall within the scope of the appended claims.

We claim the following:

1. In an internal combustion engine, particularly of the in-line type as used in automotive vehicles, which engine has an oil suction strainer arranged centrally near the bottom of its elongated oil pan and a substantially horizontally extending oil suction line connected to the top of the strainer by means of an elbow, in such an engine, a slosh baffle assembly for the stabilization of the oil level against longitudinal flowoff to either oil pan extremity comprising in combination:

a slosh baffle in the form of a panel extending substantially vertically and transversely to the oil pan, so as to form narrow flow gaps with the walls of the oil pan, thereby subdividing the latter into two oil chambers linked by said flow gaps;

a saddle portion extending substantially horizontally from the slosh baffle so as to engage the elbow of the oil suction line from above, to secure the transverse orientation of the slosh baffle;

a substantially horizontal peripheral rim on the upper end of the oil suction strainer; and means for attaching the slosh baffle to the rim of the oil suction strainer at multiple circumferentially spaced points, to secure the vertical position of the slosh baffle.

2. A slosh baffle assembly as defined in claim 1, wherein the slosh baffle attachment means includes snapaction-type attachment members defined by the slosh baffle and by the rim of the oil suction strainer.

3. A slosh baffle assembly as defined in claim 1, wherein the slosh baffle includes a substantially horizontal supporting flange below its saddle portion adapted to rest on the rim of the oil suction strainer; and the slosh baffle attachment means includes a plurality of elastically deformable snap hooks on the periphery of the supporting flange adapted to engage said rim, so as to clamp the slosh baffle assembly to the oil suction strainer.

4. A slosh baffle assembly as defined in claim 3, wherein each snap hook has the shape of an inverted "U" with vertical legs of unequal length, the extremity of the shorter leg being located radially inside the other leg and attached to the supporting flange, and the extremity of the longer, radially outer leg having a horizontally inwardly projecting retaining nose adapted to reach under the rim of the oil suction strainer.

5. A slosh baffle assembly as defined in claim 4, wherein the snap hooks are molded as integral extensions of the supporting flange;

the retaining nose of each snap hook is narrower than the width of the legs and base portion of the U-shaped hook; and each snap hook has a central vertical aperture of a horizontal cross section which is at least as large as the area of horizontal extent of the retaining nose.

6. A slosh baffle assembly as defined in claim 3, wherein the slosh baffle further includes means for centering the supporting flange in relation to the rim of the oil suction strainer.

7. A slosh baffle assembly as defined in claim 6, wherein the supporting flange centering means is defined by a plurality of centering lugs extending downwardly from the periphery of the supporting flange and engaging the periphery of the rim of the oil suction strainer.

8. A slosh baffle assembly as defined in any one of claims 3 through 7, wherein the slosh baffle, its saddle portion, supporting flange and snap hooks are integral portions of a one-piece structure which is injection-molded of plastic material.

9. A slosh baffle assembly as defined in any one of claims 3 through 7, wherein the slosh baffle extends above the oil suction strainer, immediately adjacent to the vertical portion of the elbow of the oil suction line; and the slosh baffle further includes, on at least one side thereof, a horizontal rib in alignment with the supporting flange which serves as a panel reinforcement.

* * * * *